US010746023B2

(12) United States Patent
Frasinel

(10) Patent No.: US 10,746,023 B2
(45) Date of Patent: Aug. 18, 2020

(54) BLOCK STRUCTURE AND FASTENING FEATURES FOR OPPOSED-PISTON FOUR-STROKE ENGINES

(71) Applicant: AVL Powertrain Engineering, Inc., Plymouth, MI (US)

(72) Inventor: Vasile Frasinel, Windsor (CA)

(73) Assignee: AVL Powertrain Engineering, Inc., Plymouth, MI (US)

( * ) Notice: Subject to any disclaimer, the term of this patent is extended or adjusted under 35 U.S.C. 154(b) by 7 days.

(21) Appl. No.: 16/135,813

(22) Filed: Sep. 19, 2018

(65) Prior Publication Data

US 2019/0093478 A1 Mar. 28, 2019

Related U.S. Application Data

(60) Provisional application No. 62/564,034, filed on Sep. 27, 2017.

(51) Int. Cl.
*F01B 7/14* (2006.01)
*F02B 75/28* (2006.01)
(Continued)

(52) U.S. Cl.
CPC ..... *F01B 7/14* (2013.01); *F02B 75/282* (2013.01); *F02F 1/004* (2013.01); *F02F 1/22* (2013.01); *F02F 1/186* (2013.01)

(58) Field of Classification Search
CPC ..... F01B 7/14; F02B 75/24; F02B 75/243; F02B 75/28; F02B 75/282; F02F 1/186
(Continued)

(56) References Cited

U.S. PATENT DOCUMENTS 530,523 A * 12/1894 Hirsch ..... F02B 75/28 123/51 R
1,703,752 A * 2/1929 Reineke ..... F02B 75/28 74/44
(Continued)

FOREIGN PATENT DOCUMENTS

DE 588722 C * 11/1933 ..... F02B 75/282
DE 3002412 A1 * 4/1982 ..... F01B 7/14
(Continued)

OTHER PUBLICATIONS

Search Report corresponding to German Patent Application No. 10 2018 123 678.6 dated Apr. 24, 2020, 13 pages.

*Primary Examiner* — Jacob M Amick
*Assistant Examiner* — Michael A Kessler
(74) *Attorney, Agent, or Firm* — Harness, Dickey & Pierce, P.L.C.

(57) ABSTRACT

An engine block for an opposed-piston engine includes a first center section and a second center section. The first center section defines a first cylinder half bore having a first longitudinal axis and a first plurality of fastener bores. The second center section defines a second cylinder half bore having a second longitudinal axis and a second plurality of fastener bores that extend from a first end thereof to a second end thereof. The second center section is configured to abut the first center section such that: the first and second cylinder half bores are in fluid communication with one another to collectively form a single cylinder; the first and second longitudinal axes are offset from one another; and the first and second pluralities of fastener bores are aligned with one another for receiving a first plurality of fasteners to join the first and second center sections to one another.

19 Claims, 8 Drawing Sheets

(51) Int. Cl.
*F02F 1/00* (2006.01)
*F02F 1/22* (2006.01)
*F02F 1/18* (2006.01)

(58) Field of Classification Search
USPC ..... 123/55 AA
See application file for complete search history.

(56) References Cited

U.S. PATENT DOCUMENTS

| | | | | |
|---|---|---|---|---|
| 6,250,263 | B1 | 6/2001 | Sisco | |
| 7,086,371 | B2 * | 8/2006 | Sanada | F02B 75/243 123/195 R |
| 2010/0212637 | A1 * | 8/2010 | Lemke | F01B 7/14 123/51 R |
| 2010/0212638 | A1 * | 8/2010 | Rado | F01B 7/14 123/51 R |
| 2016/0032823 | A1 * | 2/2016 | McClearen | F02B 75/28 123/51 B |
| 2016/0032861 | A1 * | 2/2016 | Fuqua | F01B 7/14 123/193.2 |
| 2016/0252043 | A1 * | 9/2016 | McClearen | F02F 1/004 123/668 |
| 2016/0252044 | A1 | 9/2016 | McClearen et al. | |
| 2019/0093479 | A1 | 3/2019 | Frasinel et al. | |

FOREIGN PATENT DOCUMENTS

| | | | | |
|---|---|---|---|---|
| DE | 102012024177 | A1 | 6/2014 | |
| GB | 360496 | A * | 11/1931 | F01B 7/14 |

* cited by examiner

BLOCK STRUCTURE AND FASTENING FEATURES FOR OPPOSED-PISTON FOUR-STROKE ENGINES

CROSS-REFERENCE TO RELATED APPLICATIONS

This application claims the benefit of U.S. Provisional Application No. 62/564,034, filed on Sep. 27, 2017. The entire disclosure of the application referenced above is incorporated herein by reference.

FIELD

The present disclosure relates to block structures and fastening features for opposed-piston four-stroke engines.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An opposed-piston engine includes an engine block defining one or more cylinders, a pair of pistons disposed within each cylinder, a crankshaft connected to each of the pistons, and one or more fuel injectors that inject fuel into each cylinder. Combustion of an air/fuel mixture within the cylinder causes the pistons to translate toward one another and away from one another, which drives rotation of the crankshaft. The engine block also defines an intake port that allows intake air to enter the cylinder, and an exhaust port that allow exhaust gas to be expelled from the cylinder.

In an opposed-piston two-stroke (OP2S) engine, the intake and exhaust ports typically extend through the sidewall of each cylinder and are disposed near opposite ends of the cylinder. When the pistons pass the intake and exhaust ports as the pistons are moving away from each other during a combustion or power stroke, intake air is drawn through the intake port while exhaust gas is expelled through the exhaust port. When the pistons pass the intake and exhaust ports as the pistons are moving toward each other during a compression stroke, the pistons prevent flow through the intake and exhaust ports. Since movement of the pistons controls flow through the intake and exhaust ports, there is no need for intake or exhaust valves.

Some opposed-piston four-stroke (OP4S) engines also control flow through the intake and exhaust ports using piston movement rather than intake and exhaust valves. In such an OP4S engine, intake air is drawn into the cylinder and exhaust gas is expelled from the cylinder at different times. Intake air is drawn into the cylinder when the pistons pass the intake and exhaust ports as the pistons move away from each other during an intake stroke. Fuel is injected into the cylinder, and the air/fuel mixture is compressed as the pistons move toward each other during a compression stroke. This compression causes the air/fuel mixture to ignite, and the combustion pressure urges the pistons to move away from each other during a combustion or power stroke. The pistons once again pass the intake and exhaust ports, and exhaust gas is expelled from the cylinder as the pistons move toward each other during an exhaust stroke.

Controlling flow through the intake and exhaust ports using piston movement limits the ability to adjust the timing and amount of flow through the intake and exhaust ports relative to controlling flow through the intake and exhaust ports using intake and exhaust valves. While attempts have been made to design an OP4S engine that controls flow through the intake and exhaust ports using intake and exhaust valves, the attempts have resulted in cost, manufacturing, assembly, and serviceability issues.

SUMMARY

A first example of an engine block for an opposed-piston engine according to the present disclosure includes a first center section and a second center section. The first center section defines a first cylinder half bore and a first plurality of fastener bores that extend from a first end of the first center section to a second end of the first center section. The first cylinder half bore has a first longitudinal axis. The second center section defines a second cylinder half bore and a second plurality of fastener bores that extend from a first end of the second center section to a second end of the second center section. The second cylinder half bore has a second longitudinal axis. The first end of the second center section is configured to abut the second end of the first center section such that: the first and second cylinder half bores are in fluid communication with one another to collectively form a single cylinder; the first and second longitudinal axes are offset from one another; and the first and second pluralities of fastener bores are aligned with one another for receiving a first plurality of fasteners to join the first and second center sections to one another.

In one example, each fastener bore in the first plurality of fastener bores has a first counterbore located at the first end of the first center section, and each fastener bore in the second plurality of fastener bores has a second counterbore located at the second end of the second center section.

In one example, the engine block further includes a first crankcase and a second crankcase. The first crankcase at least partially defines a first crankshaft bore configured to receive a first crankshaft. The first crankcase is configured to abut the first end of the first center section. The second crankcase at least partially defines a second crankshaft bore configured to receive a second crankshaft. The second crankcase is configured to abut the second end of the second center section.

In one example, the first center section defines a third plurality of fastener bores that are offset from the first plurality of fastener bores and are configured to receive a second plurality of fasteners to join the first crankcase to the first center section, and the second center section defines a fourth plurality of fastener bores that are offset from the second plurality of fastener bores and are configured to receive a third plurality of fasteners to join the second crankcase to the second center section.

In one example, the third plurality of fastener bores have internal threads for engaging external threads on the second plurality of fasteners, and the fourth plurality of fastener bores have internal threads for engaging external threads on the third plurality of fasteners.

In one example, the first crankcase defines a first plurality of through bores configured to be aligned with the third plurality of fastener bores to allow insertion of the second plurality of fasteners through the first plurality of through bores and into the third plurality of fastener bores to join the first crankcase to the first center section, and the second crankcase defines a second plurality of through bores configured to be aligned with the fourth plurality of fastener bores to allow insertion of the third plurality of fasteners through the second plurality of through bores and into the fourth plurality of fastener bores to join the second crankcase to the second center section.

In one example, the engine block further includes a first crank bearing saddle and a second crank bearing saddle, each of the first crankcase and the first crank bearing saddle defining a crankshaft partial bore, the crankshaft partial bore in the first crankcase cooperating with the crankshaft partial bore in the first crank bearing saddle to form the first crankshaft bore, each of the second crankcase and the second crank bearing saddle defining a crankshaft partial bore, the crankshaft partial bore in the second crankcase cooperating with the crankshaft partial bore in the second crank bearing saddle to form the second crankshaft bore.

A second example of an engine block for an opposed-piston engine according to the present disclosure includes a first center section, a second center section, a first crankcase, a second crankcase, a first plurality of fasteners, a second plurality of fasteners, and a third plurality of fasteners. The first center section defines a first cylinder half bore having a first longitudinal axis. The second center section defines a second cylinder half bore having a second longitudinal axis that is offset from the first longitudinal axis. The first and second cylinder half bores are fluid communication with one another. The first crankcase at least partially defines a first crankshaft bore. The second crankcase at least partially defines a second crankshaft bore. The first plurality of fasteners joins the first and second center sections to one another. The second plurality of fasteners joins the first crankcase to the first center section. The third plurality of fasteners joins the second crankcase to the second center section.

In one example, the first cylinder half bore extends from a first end of the first center section to a second end of the first center section, the second cylinder half bore extends from a first end of the second center section to a second end of the second center section, the first end of the second center section abuts the second end of the first center section, the first crankcase abuts the first end of the first center section, and the second crankcase abuts the second end of the second center section.

In one example, the first center section defines a first plurality of fastener bores that extend from the first end of the first center section to the second end of the first center section, the second center section defines a second plurality of fastener bores that extend from the first end of the second center section to the second end of the second center section, and the first plurality of fasteners extend through the first plurality of fastener bores and the second plurality of fastener bores to join the first and second center sections to one another.

In one example, the engine block further comprises a first crank bearing saddle and a second crank bearing saddle. Each of the first crankcase and the first crank bearing saddle defining a crankshaft partial bore. The crankshaft partial bore in the first crankcase cooperate with the crankshaft partial bore in the first crank bearing saddle to form the first crankshaft bore. The second plurality of fasteners extend through the first crank bearing saddle and the first crankcase to join the first crank bearing saddle and the first crankcase to the first center section. Each of the second crankcase and the second crank bearing saddle define a crankshaft partial bore. The crankshaft partial bore in the second crankcase cooperates with the crankshaft partial bore in the second crank bearing saddle to form the second crankshaft bore. The third plurality of fasteners extend through the second crank bearing saddle and the second crankcase to join the second crank bearing saddle and the second crankcase to the second center section.

In one example, the first crankcase and the first crank bearing saddle form a first crankcase assembly having a central horizontal plane that is offset from a central horizontal plane of the first center section, and the second crankcase and the second crank bearing saddle form a second crankcase assembly having a central horizontal plane that is offset from a central horizontal plane of the second center section.

A first example of an opposed-piston engine according to the present disclosure includes the engine block, a first crankshaft received in the first crankshaft bore, and a second crankshaft received in the second crankshaft bore. The first crankshaft has a longitudinal axis that is disposed within the same plane as the first longitudinal axis of the first cylinder half bore. The second crankshaft has a longitudinal axis that is disposed within the same plane as the second longitudinal axis of the second cylinder half bore.

In one example, each fastener in the first plurality of fasteners has a first length, each fastener in the second plurality of fasteners has a second length, each fastener in the third plurality of fasteners has a third length, and the second and third lengths are greater than the first length.

A third example of an engine block for an opposed-piston engine according to the present disclosure includes a first center section, a second center section, a first crankcase assembly, and a second crankcase assembly. The first center section has a central horizontal plane and defines at least one first cylinder half bore having a first longitudinal axis. The second center section has a central horizontal plane and defines at least one second cylinder half bore having a second longitudinal axis that is offset from the first longitudinal axis. The at least one first cylinder half bore is in fluid communication with the at least one second cylinder half bore to form at least one cylinder. The first crankcase assembly defines a first crankshaft bore and has a central horizontal plane that is offset from the central horizontal plane of the first center section. The second crankcase assembly defines a second crankshaft bore and has a central horizontal plane that is offset from the central horizontal plane of the second center section.

In one example, the second longitudinal axis of the at least one second cylinder half bore is offset from the first longitudinal axis of the at least one first cylinder half bore by a first distance, the central horizontal plane of the first crankcase assembly is offset from the central horizontal plane of the first center section by a second distance, the central horizontal plane of the second crankcase assembly is offset from the central horizontal plane of the second center section by the second distance, and the second distance is equal to one-half of the first distance.

In one example, the first crankcase assembly includes a first crankcase and a first crank bearing saddle that cooperate with one another to form the first crankshaft bore, and the second crankcase assembly includes a second crankcase and a second crank bearing saddle that cooperate with one another to form the second crankshaft bore.

A second example of an opposed-piston engine according to the present disclosure includes the engine block, a first crankshaft received in the first crankshaft bore, and a second crankshaft received in the second crankshaft bore. The first crankshaft has a longitudinal axis that is disposed within the same plane as the first longitudinal axis of the at least one first cylinder half bore. The second crankshaft has a longitudinal axis that is disposed within the same plane as the second longitudinal axis of the at least one second cylinder half bore.

In one example, the engine block further includes at least one first piston connected to the first crankshaft and configured to reciprocate within the at least one first cylinder half bore, and at least one second piston connected to the second crankshaft and configured to reciprocate within the at least one first cylinder half bore. Combustion within the at least one cylinder causes the at least one first piston and the at least one second piston to translate toward one another and away from one another, which drives rotation of the first and second crankshafts.

In one example, the at least one first cylinder half bore includes a plurality of first cylinder half bores, the at least one second cylinder half bore includes a plurality of second cylinder half bores, each of the second cylinder half bores is in fluid communication with one of the first cylinder half bores, the at least one first piston includes a plurality of first pistons, each of the first pistons is configured to reciprocate within one of the first cylinder half bores, the at least one second piston includes a plurality of second pistons, and each of the second pistons is configured to reciprocate within one of the second cylinder half bores.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
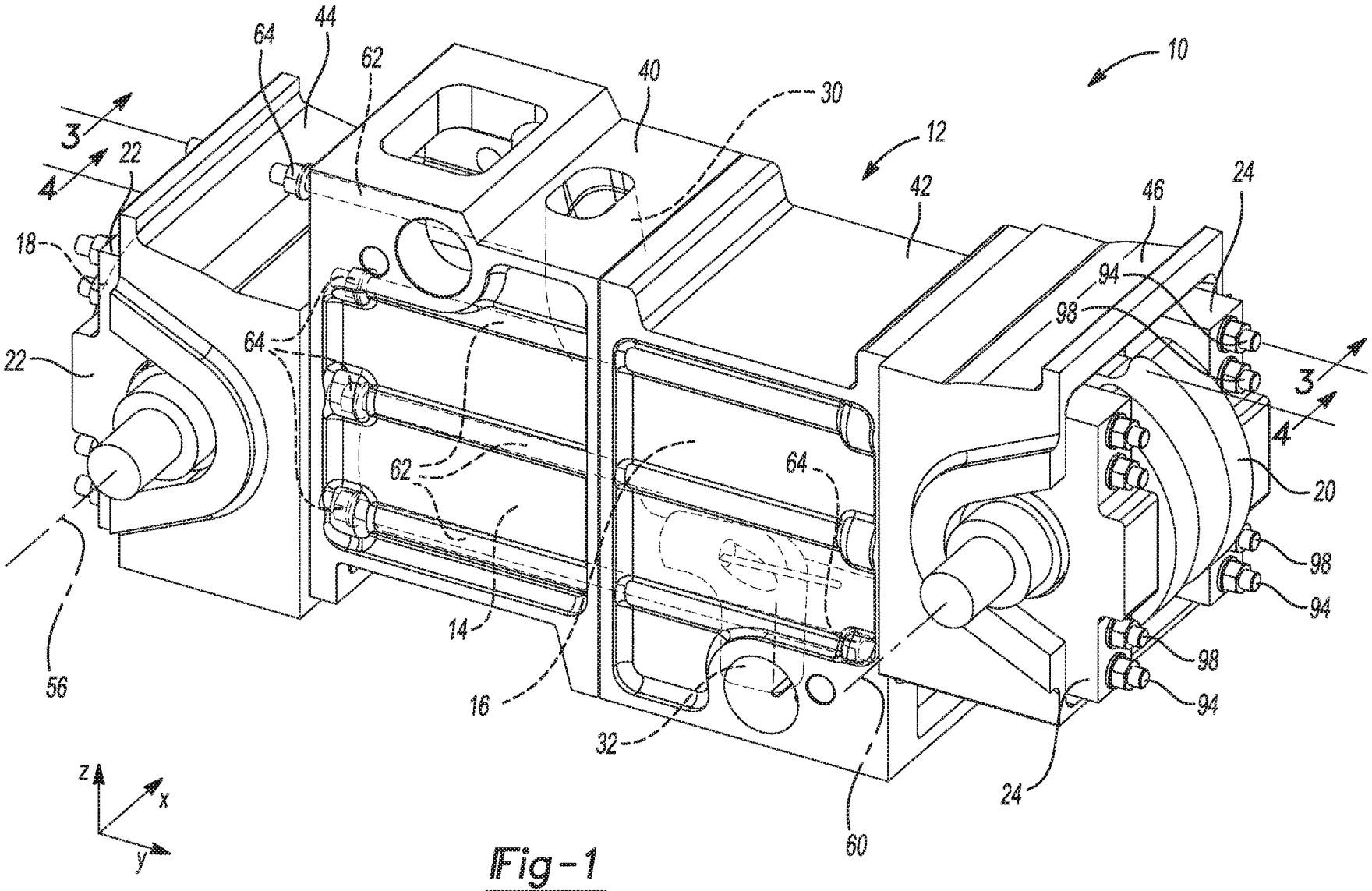
FIG. 1 is a perspective view of an opposed-piston four-stroke (OP4S) engine according to the present disclosure with two center sections of an engine block shown in phantom to illustrate components otherwise hidden by the engine block.

As discussed above, attempts have been made to design an OP4S engine that controls flow through the intake and exhaust ports using intake and exhaust valves. For example, U.S. Pat. No. 6,250,263 describes an OP4S engine including a one-piece engine block defining a cylinder that is split into two halves which are in fluid communication with one another. The cylinder halves are offset from one another to provide packaging space for intake and exhaust valve trains. This allows the intake and exhaust ports to extend through the end of each cylinder half rather than extending through the sidewall of the cylinder as in most OP2S engines.

However, the one-piece engine block would be difficult and costly to manufacture, assemble, and service. In addition, the one-piece engine block of the '263 patent would require inserting a liner for each cylinder half into one end of the engine block, which would require a complicated, stepped sealing structure between the cylinder liner and the block structure. Further, accommodating the stepped sealing structure would require increasing bore spacing and packaging length.

The manufacturability, assemble-ability, and serviceability of the engine block of the '263 patent may be improved by splitting the engine block into two halves. The two block halves may be fastened together using fasteners extending through flanges projecting from opposite sides of each block half adjacent to the parting line. This would enable inserting a cylinder liner into each cylinder half through the end of each cylinder half that is in fluid communication with another cylinder half. In turn, the sealing structure between the cylinder liner and the block structure may be simplified. However, in such a design, all of the tensile loads in the block would be carried by short fasteners extending through the flanges. Therefore, such a design would yield high stresses along the flanges, and therefore would require a much heavier block structure (due to the additional mass of the flanges) and/or cause failures of the block structure.

U.S. Publication No. 2016/0252044 describes a multi-piece engine block design for an engine that may operate using two strokes or four strokes. The block pieces include two center sections that each define a cylinder half, and two outer sections or crankcases that each support a crankshaft. In addition, rather than use fastening flanges to join the pieces of the block together as described above, the block pieces are joined together using long threaded rods that extend through all of the block pieces. However, the engine of the '044 publication controls flow through the intake and exhaust ports using piston movement rather than intake and exhaust valves. Thus, the block pieces define cylinder halves that are coaxial with one another. If the block pieces defined cylinder halves that were offset from one another to provide packaging space for intake and exhaust valve trains, the long threaded rods would likely interfere with crankshafts supported by the outermost block pieces. In addition, the long threaded rods would likely have a high clamping load due to their length, which may distort the outermost pieces of the crankcases (i.e., the main bearing caps).

The multi-piece engine block of the '044 publication may be modified to avoid interference between the long threaded rods and the crankshafts by offsetting the crankshaft centerlines to the thrust or anti-thrust axis of the cylinder bores. This would allow the threaded rods to go through both center sections and the main bearing caps for one of the crankshafts. However, such an arrangement may compromise the valve train layout, increase engine height, and adversely affect the piston thrust force/friction and the amount of noise produced by the engine. In addition, in such an arrangement, the long threaded rods would likely have a high clamping load due to their length which, as noted above, may distort the main bearing caps.

An OP4S engine according to the present disclosure includes an engine block having two center sections and two crankcases. Each of the center sections defines a cylinder half, and the cylinder halves are offset from one another to provide packaging space for intake and exhaust valvetrains. The center sections are joined together using long threaded rods, and the crankcases and crank bearing saddles are joined to opposite ends of the center section assembly using shorter threaded rods or bolts.

Since the crankcases are not joined to the center section assembly using the long threaded rods, interference between the long threaded rods and crankshafts in the crankcases is avoided. In addition, since the threaded rods or fasteners joining the crankcases to the center section assembly are shorter, the threaded rods or fasteners have a lower clamping force and are less likely to distort the main bearing caps. Further, the crankcases are offset relative to the center sections to allow alignment of the bore centers, the crankshaft, and the crank bearing main caps or saddles. Moreover, the overall structure and fastening scheme of the OP4S engine according to the present disclosure allows for more flexible and cost effective casting, machining, assembly, and servicing while maintaining structural integrity.

Figure 2:
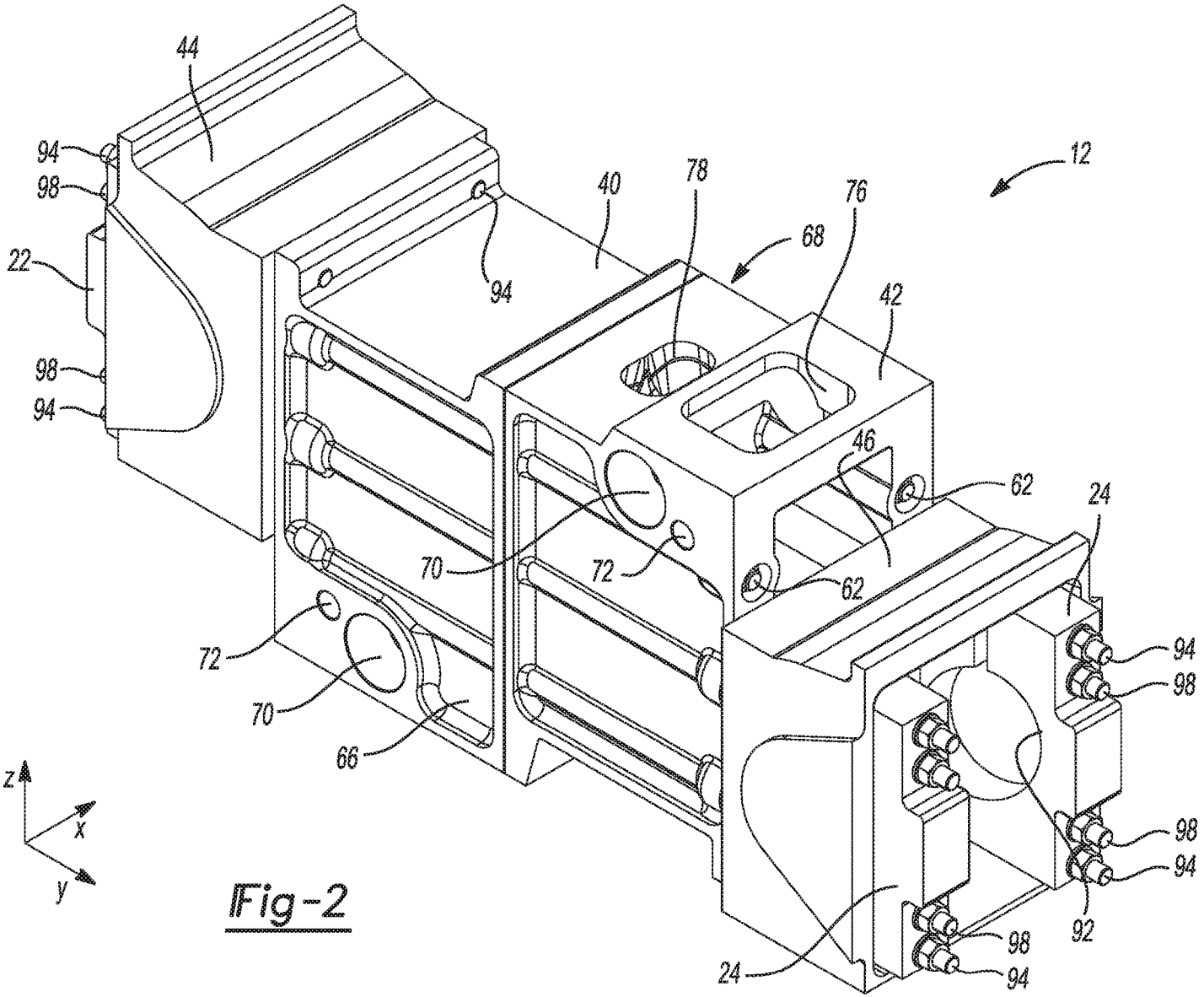
FIG. 2 is a perspective view of the engine block of the OP4S engine of FIG. 1 and fasteners that hold sections of the engine block together.
Figure 3:
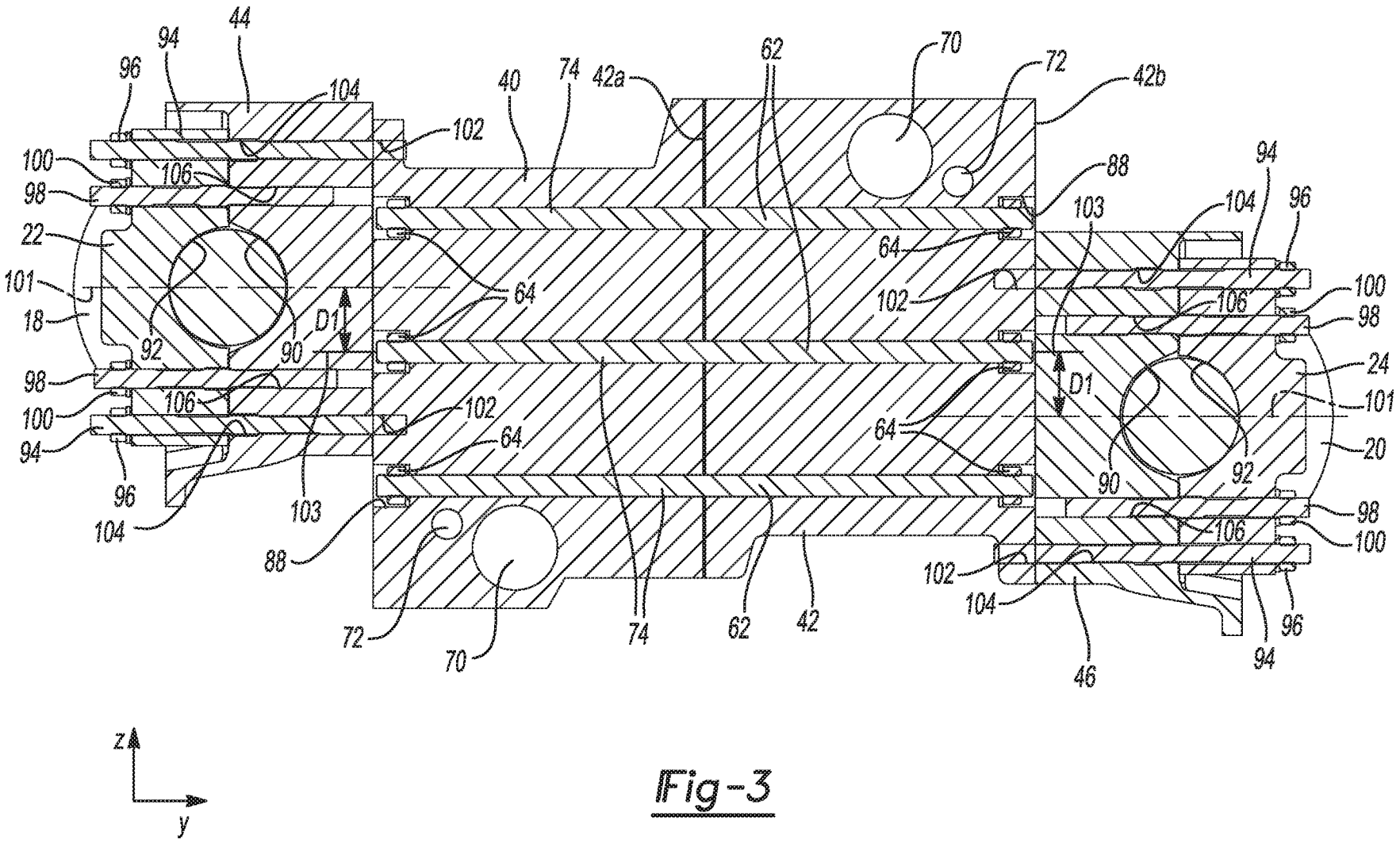
FIG. 3 is a cross-sectional view of the OP4S engine of FIG. 1 taken along a line 3-3 shown in FIG. 1.
Figure 4:
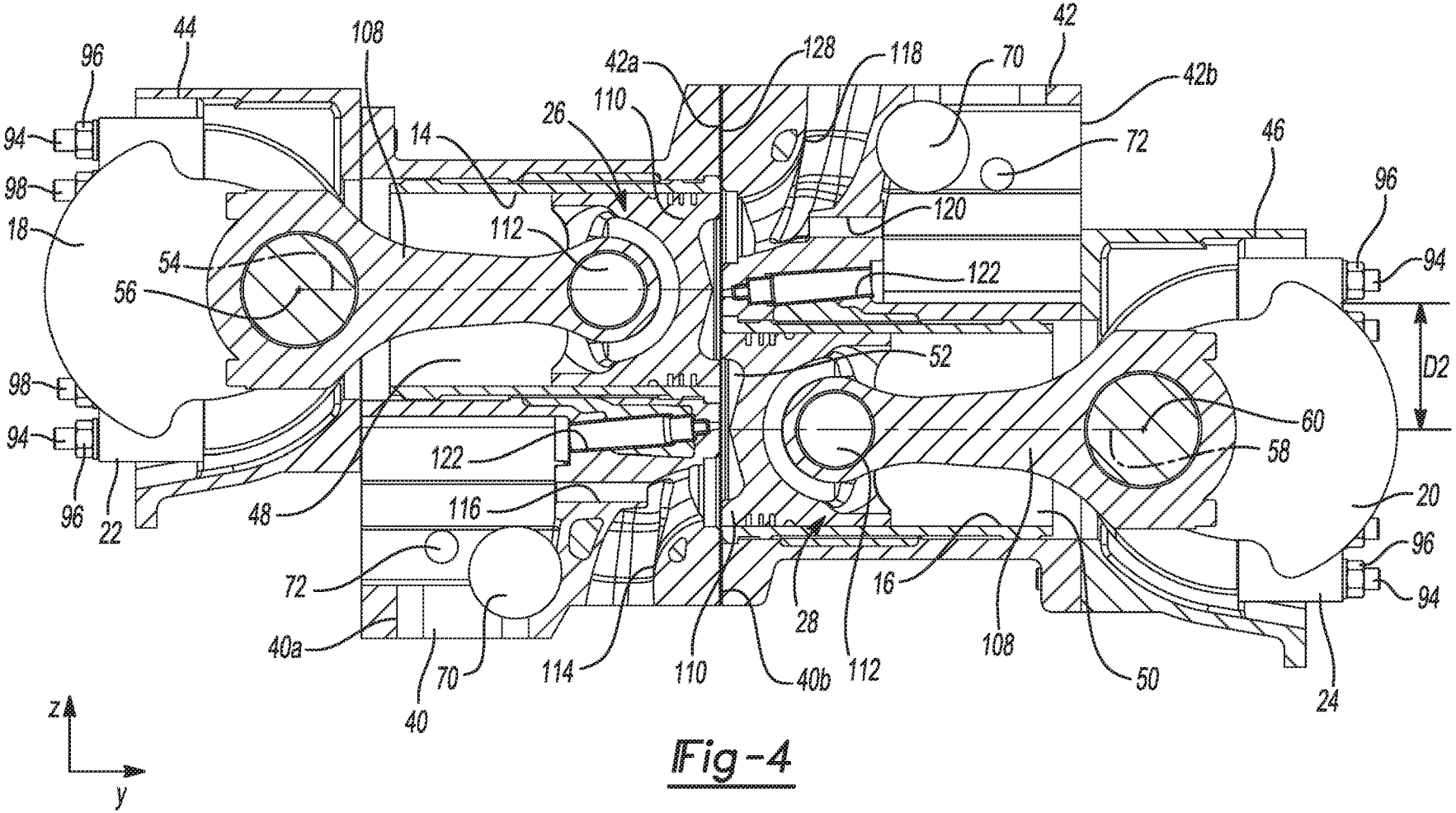
FIG. 4 is a cross-sectional view of the OP4S engine of FIG. 1 taken along a line 4-4 shown in FIG. 1.
Figure 5:
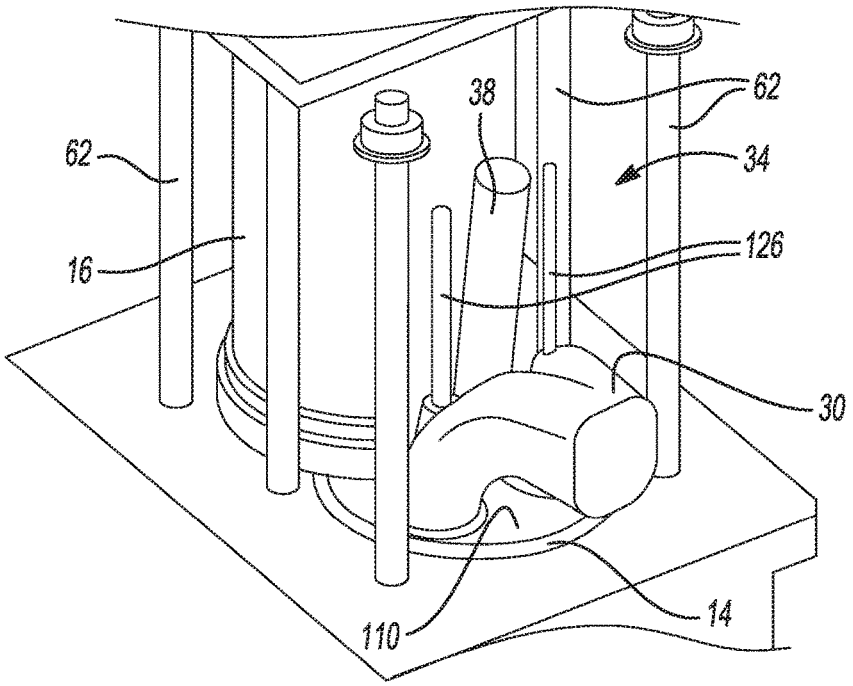
FIG. 5 is a perspective view of a portion of the OP4S engine of FIG. 1 with one of the center sections of the engine block omitted to illustrate components otherwise in by the omitted center section.
Figure 6:
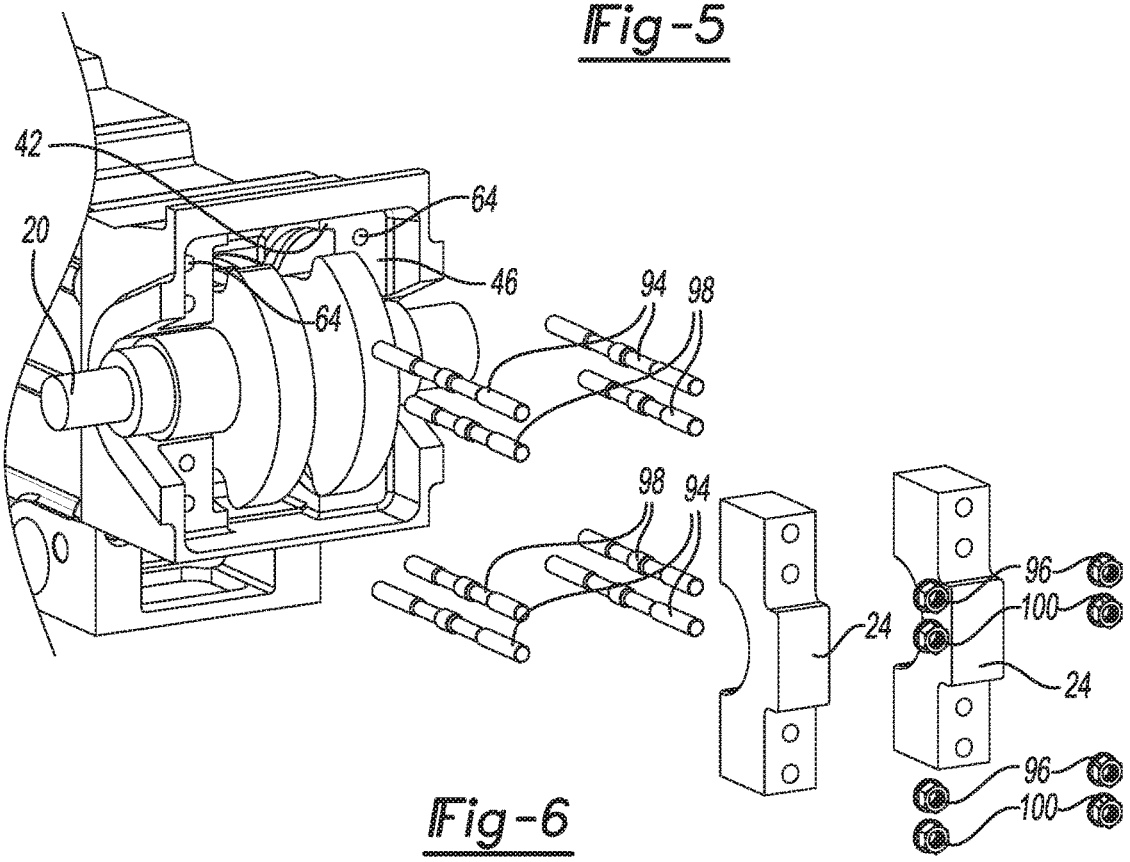
FIG. 6 is another perspective view of a portion of the OP4S engine of FIG. 1 with a pair of crank bearing saddles and corresponding fasteners exploded from the remainder of the OP4S engine.

Referring now to FIGS. 1-7, an opposed-piston four-stroke (OP4S) engine 10 includes an engine block 12, first and second cylinder liner halves 14 and 16, first and second crankshafts 18 and 20, first and second crank bearing main caps or saddles 22 and 24, first and second pistons 26 and 28 (FIG. 4), intake and exhaust manifolds 30 and 32, intake and exhaust valve trains 34 and 36 (FIGS. 5 and 7), and first and second fuel injectors 38 (only one shown in FIG. 5). The engine block 12 includes first and second center sections 40 and 42 and first and second lower crankcases 44 and 46. The first and second center sections 40 and 42 and the first and second lower crankcases 44 and 46 are formed (e.g., cast) separately (e.g., from iron). As best shown in FIG. 4, the first center section 40 defines a first cylinder half bore 48 that extends from a first end 40*a* thereof to a second end 40*b* thereof, and the second center section 42 defines a second cylinder half bore 50 that extends from a first end 42*a* thereof to a second end 42*b* thereof. The first and second cylinder half bores 48 and 50 are in fluid communication with one another through an opening 52 in the engine block 12. Therefore, the first and second cylinder half bores 48 and 50 collectively form a single cylinder within which the first and second pistons 26 and 28 reciprocate.

A longitudinal axis 54 of the first cylinder half bore 48 is disposed within the same plane as a longitudinal axis 56 of the first crankshaft 18. Similarly, a longitudinal axis 58 of the second cylinder half bore 50 is disposed within the same plane as a longitudinal axis 60 of the second crankshaft 20. In addition, the longitudinal axes 54, 58 of the first and second cylinder half bores 48 and 50 are aligned with one another in a longitudinal direction X that is parallel to the longitudinal axes 56, 60 of the first and second crankshafts 18, 20. Further, the longitudinal axes 54, 58 of the first and second cylinder half bores 48 and 50 are offset from one another in a vertical direction Z to provide packaging space for the intake and exhaust valve trains 34 and 36.

When the first and second center sections 40 and 42 are joined to one another, the first end 42*a* of the second center section 42 abuts the second end 40*b* of the first center section 40. The first and second center sections 40 and 42 are joined to one another using six first threaded rods 62 and twelve first nuts 64, with a pair of the first nuts 64 threaded to opposite ends of each of the first threaded rods 62. Three of the first threaded rods 62 are disposed on a first side 66 of the engine block 12, and three of the first threaded rods 62 are disposed on a second side 68 of the engine block 12 opposite of the first side 66. On each of the first and second sides 66 and 68 of the engine block 12, the three first threaded rods 62 are evenly spaced from one another in the vertical direction Z.

Each of the first and second center sections 40 and 42 defines a camshaft bore 70, a rocker arm shaft bore 72, a plurality of fastener bores 74, a valve train opening 76 (FIG. 2), and a manifold opening 78 (FIG. 2). The camshaft bore 70 in the first center section 40 receives an intake camshaft 80 (FIG. 7) of the intake valve train 34, and the camshaft bore 70 in the second center section 42 receives an exhaust camshaft 82 (FIG. 7) of the exhaust valve train 36. The rocker arm shaft bore 72 in the first center section 40 receives an intake rocker arm shaft 84 (FIG. 7) in the intake valve train 34, and the rocker arm shaft bore 72 and the second center section 42 receives an exhaust rocker arm shaft (not shown) in the exhaust valve train 36.

Each of the fastener bores 74 receives one of the first threaded rods 62 and has a counterbore 88 (FIG. 3) that receives one of the first nuts 64. Each of the fastener bores 74 in the first center section 40 extends from the first end 40*a* thereof to the second end 40*b* thereof. Similarly, each of the fastener bores 74 in the second center section 42 extends from the first end 42*a* thereof to the second end 42*b* thereof. Each of the valve train openings 76 in the first and second center sections 40 and 42 receives a valve cover (not shown). In addition, the valve train openings 76 in the first and second center sections 40 and 42 can receive fuel lines (not shown) that provide fuel to the fuel injectors 38. The manifold openings 78 allow the intake and exhaust manifolds 30 and 32 to extend outside of the engine block 12.

Each of the first and second lower crankcases 44 and 46 defines a crankshaft partial bore 90, and each pair of the first and second crank bearing saddles 22 and 24 defines a crankshaft partial bore 92. The crankshaft partial bore 90 in the first lower crankcase 44 cooperates with the crankshaft partial bore 92 defined by the first crank bearing saddle 22 to form a crankshaft bore that receives the first crankshaft 18. Similarly, the crankshaft partial bore 90 in the second lower crankcase 46 cooperates with the crankshaft partial bore 92 defined by the second crank bearing saddles 24 to form a crankshaft bore that receives the second crankshaft 20. The first and second crank bearing saddles 22 and 24 may be considered part of the engine block 12.

When the first crank bearing saddles 22 and the first lower crankcase 44 are joined to the first center section 40, the first lower crankcase 44 abuts the first end 40*a* of the first center section 40. When the second crank bearing saddles 24 and the second lower crankcase 46 are joined to the second center section 42, the second lower crankcase 44 abuts the second end 42*b* of the second center section 42*b*. As best shown in FIG. 3, the first crank bearing saddles 22 and the first lower crankcase 44 are joined to the first center section 40 using four second threaded rods 94 disposed near the four corners of the first lower crankcase 44, and four second nuts 96 threaded onto the four threaded rods 94. Similarly, the second crank bearing saddles 24 and the second lower crankcase 46 are joined to the second center section 42 using four of the second threaded rods 94 and four of the second nuts 96. The first crank bearing saddles 22 are joined to the first lower crankcase 44 using four third threaded rods 98 disposed between the second threaded rods 94 and the first crankshaft 18, and four third nuts 100 threaded onto the third threaded rods 98. Similarly, the second crank bearing saddles 24 are joined to the second lower crankcase 46 using four of the third threaded rods 98 and four of the third nuts 100. The first threaded rods 62 have a first length, the second threaded rods 94 have a second length that is less than the first length, and the third threaded rods 98 have a third length that is less than the second length. The first, second, and third threaded rods 62, 94, and 98 and/or the first, second, and third nuts 64, 96, and 100 may be considered part of the engine block 12.

The first crank bearing saddle 22 and the first lower crankcase 44 form a first crankcase assembly, while the second crank bearing saddle 22 and the second lower crankcase 46 form a second crankcase assembly. A central horizontal plane 101 of each of the first and second crankcase assemblies is offset in the vertical direction Z relative to a central horizontal plane 103 of each of the first and second center sections 40 and 42. The central horizontal plane 101 of the first crankcase assembly is offset in the vertical direction Z relative to the central horizontal plane 103 of the first center section 40 by a first distance D1 (FIG. 3). Similarly, the central horizontal plane 101 of the second crankcase assembly is offset in the vertical direction Z relative to the central horizontal plane 103 of the second center section 42 by the first distance D1. The first distance D1 is equal to one-half of a second distance D2 (FIG. 4) by which the longitudinal axes 54 and 56 of the first and second cylinder bore halves 48 and 50 are offset from one another.

Offsetting the central horizontal plane 101 of each of the first and second crankcase assemblies relative to the central horizontal plane 103 of each of the first and second center sections 40 and 42 enables the size and mass of the crankcase assemblies to be reduced. To this end, the offset enables the first and second crankcase assemblies to be centered about the longitudinal axes 56 and 60 of the first and second crankshafts 18 and 20 in the vertical direction Z. This minimizes the amount of material that the first and second crankcase assemblies must include to accommodate the second and third threaded rods 94 and 98.

Each of the first and second center sections 40 and 42 defines fastener bores 102 having internal threads that engage external threads on the second threaded rods 94. Each of the first and second lower crankcases 44 and 46 defines through bores 104 that receive the second threaded rods 94 and blind bores 106 having internal threads that engage external threads on the third threaded rods 98. In various implementations, the second threaded rods 94, the second nuts 96, the third threaded rods 98, and/or the third nuts 100 may be replaced with screws or bolts.

With specific reference to FIG. 4, the first cylinder liner half 14 is placed within the first cylinder half bore 48, and the second cylinder liner half 16 is placed within the second cylinder half bore 50. The first piston 26 reciprocates within the first cylinder liner half 14, and the second piston 28 reciprocates within the second cylinder liner half 16. Each of the first and second pistons 26 and 28 includes a connecting rod 108, a piston head 110, and a wristpin 112. The connecting rod 108 of the first piston 26 connects the piston head 110 of the first piston 26 to the first crankshaft 18. Similarly, the connecting rod 108 of the second piston 28 connects the piston head 110 of the second piston 28 to the second crankshaft 20. The wristpins 112 join the piston heads 110 to the connecting rods 108 while allowing the connecting rods 108 to pivot with respect to the piston heads 110.

The first center section 40 defines intake ports 114 and intake valve bores 116, the second center section 42 defines exhaust ports 118 and an exhaust valve bores 120, and each of the first and second center sections 40 and 42 defines a fuel injector bore 122. Each of the intake ports 114 is in fluid communication with the intake manifold 30, and each of the exhaust ports 118 is in fluid communication with the exhaust manifold 32. Each of the fuel injector bores 122 receives one of the fuel injectors 38.

Figure 7:
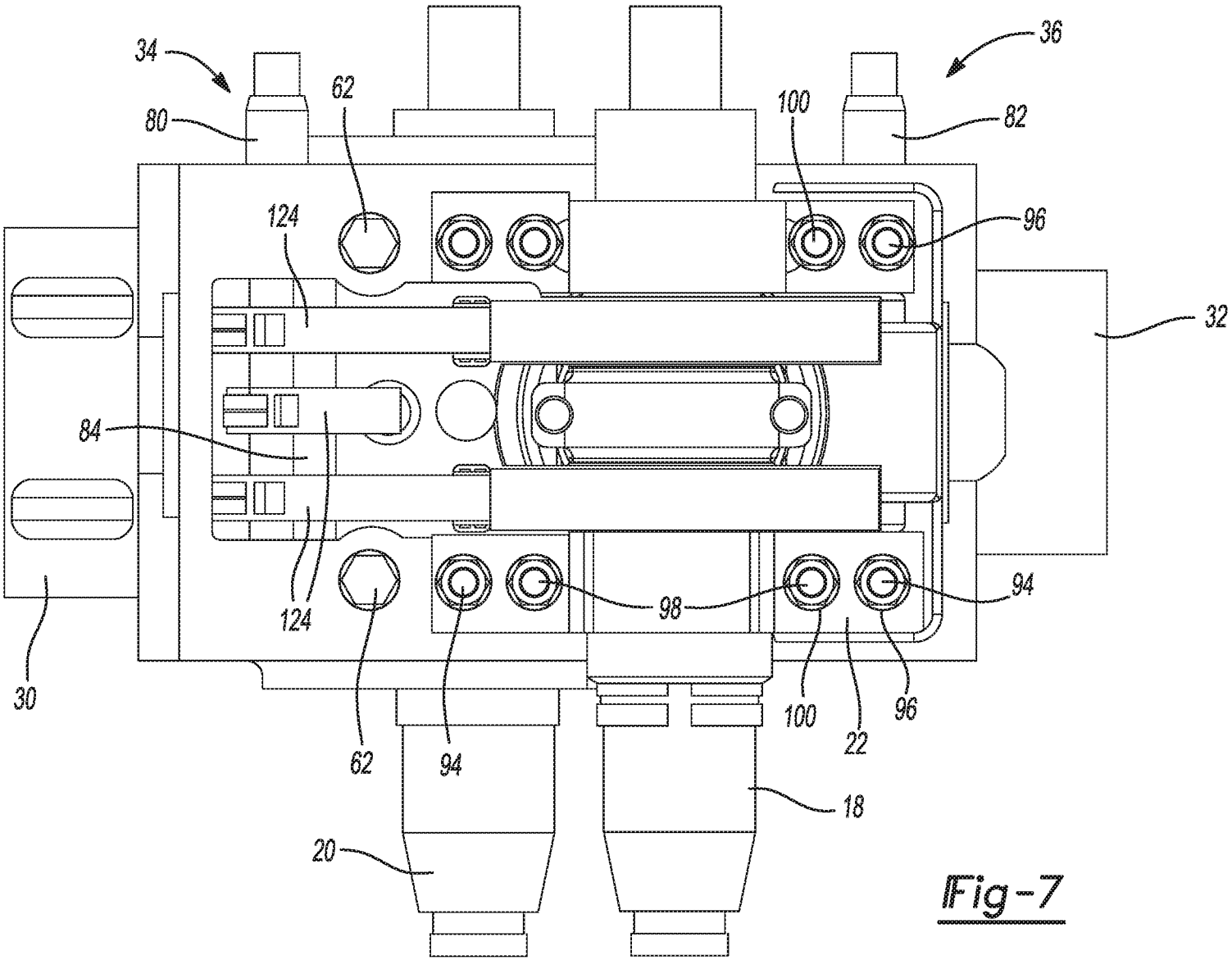
FIG. 7 is an end view of the OP4S engine of FIG. 1 is one of the crank bearing saddles omitted.

With additional reference to FIGS. 5 and 7, the intake valve train 34 includes the intake camshaft 80, the intake rocker arm shaft 84, intake rocker arms 124, and intake valves 126. While FIG. 5 shows only two of the intake valves 126, FIG. 7 shows three of the intake rocker arms 124 because FIG. 7 corresponds to a configuration where intake valve train 34 includes three of the intake valves 26. Each of the intake valve bores 116 in the first center section 40 receives one of the intake valves 126. The intake camshaft 80 is driven by the first crankshaft 18, and the intake rocker arms 124 pivot about the intake rocker arm shaft 84 when the intake rocker arms 124 engage lobes on the intake camshaft 80. In turn, the intake valves 126 unseat from the intake ports 114 and move further into the first cylinder half bore 48, thereby allowing intake air to be drawn into the first and second cylinder half bores 48 and 50.

The exhaust valve train 36 includes the exhaust camshaft 82, the exhaust rocker arm shaft, exhaust rocker arms (not shown), and exhaust valves (not shown). The exhaust rocker arm shaft, the exhaust rocker arms, and the exhaust valves may have the same structure and function as the intake rocker arm shaft 84, the intake rocker arms 124, and the intake valves 126, respectively. Each of the exhaust valve bores 120 in the second center section 42 receives one of the exhaust valves. The exhaust camshaft 82 is driven by the second crankshaft 20, and the exhaust rocker arms pivot about the exhaust rocker arm shaft when the exhaust rocker arms engage lobes on the exhaust camshaft 82. In turn, the exhaust valves unseat from the exhaust ports 118 and move further into the second cylinder half bore 50, thereby allowing exhaust gas to be expelled from the first and second cylinder half bores 48 and 50.

The OP4S engine 10 may be a compression-ignition engine or a spark-ignition engine. In addition, as its name indicates, the OP4S engine 10 operates using four strokes—an intake stroke, a compression stroke, a power stroke, and an exhaust stroke. During the intake stroke, the intake valves 126 are open (i.e., unseated from the intake ports 114), and the first and second pistons 26 and 28 move from the positions shown in FIG. 4 in a direction away from each other. The motion of the first and second pistons 26 and 28 creates a vacuum that draws intake air through the intake ports 114 and into the first and second cylinder half bores 48 and 50. In addition, the fuel injectors 38 may inject fuel into the first and second cylinder half bores 48 and 52 to yield an air-fuel mixture.

During the compression stroke, the intake valves 126 are closed (i.e., seated against the intake ports 114), and the first and second pistons 26 and 28 move toward one another to the positions shown in FIG. 4, which are commonly referred to as top dead center. When the first and second pistons 26 and 28 are near top and center, the pressure within the first and second cylinder half bores 48 and 50 causes the air-fuel mixture to ignite (i.e., if the OP4S engine 10 is a compression-ignition engine) or a spark produced by a spark plug (not shown) causes the air-fuel mixture to ignite (i.e., if the OP4S engine 10 is a spark-ignition engine). During the power stroke, a rapid pressure increase within the first and second cylinder half bores 48 and 50 resulting from combustion of the air-fuel mixture causes the first and second pistons 26 and 28 to move away from one another. As the first and second pistons 26 and 28 move away from one another, the first and second pistons 26 and 28 drive the first and second crankshaft 18 and 20, respectively.

During the exhaust stroke, the exhaust valves are open (i.e., unseated from the exhaust ports 118), and the first and second pistons 26 and 28 move toward each other to the positions shown in FIG. 4. The motion of the first and second pistons 26 and 28 increases the pressure within the first and second cylinder half bores 48 and 50, which forces exhaust gas out the first and second cylinder half bores 48 and 50 through the exhaust ports 118. A gasket 128 seals the interface between the first and second center sections 40 and 42 to prevent exhaust gas from escaping the first and second cylinder half bores 48 and 50 through a path other than the exhaust ports 118.

Figure 8:
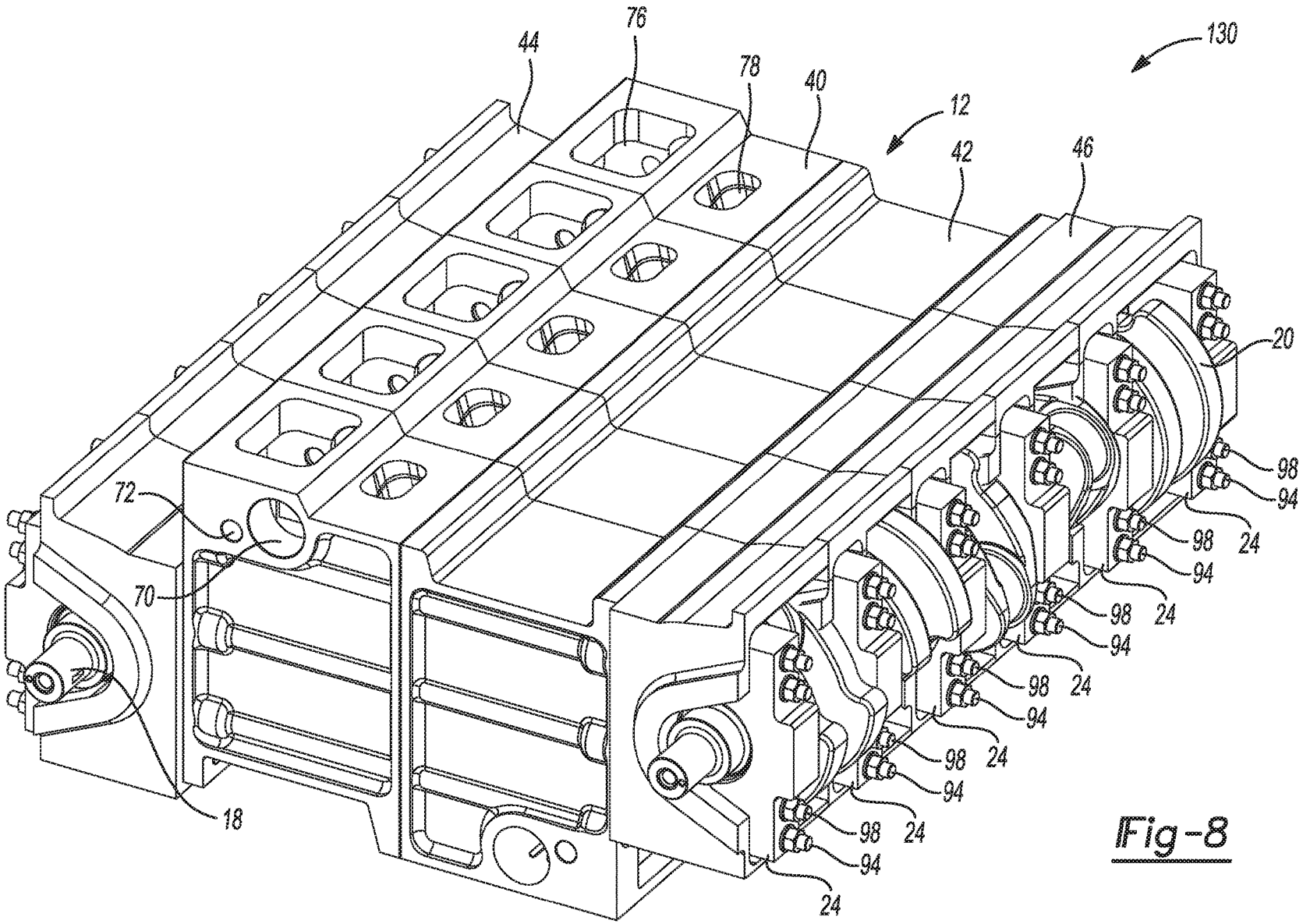
FIG. 8 is a perspective view of another OP4S engine according to the present disclosure.
Figure 9:
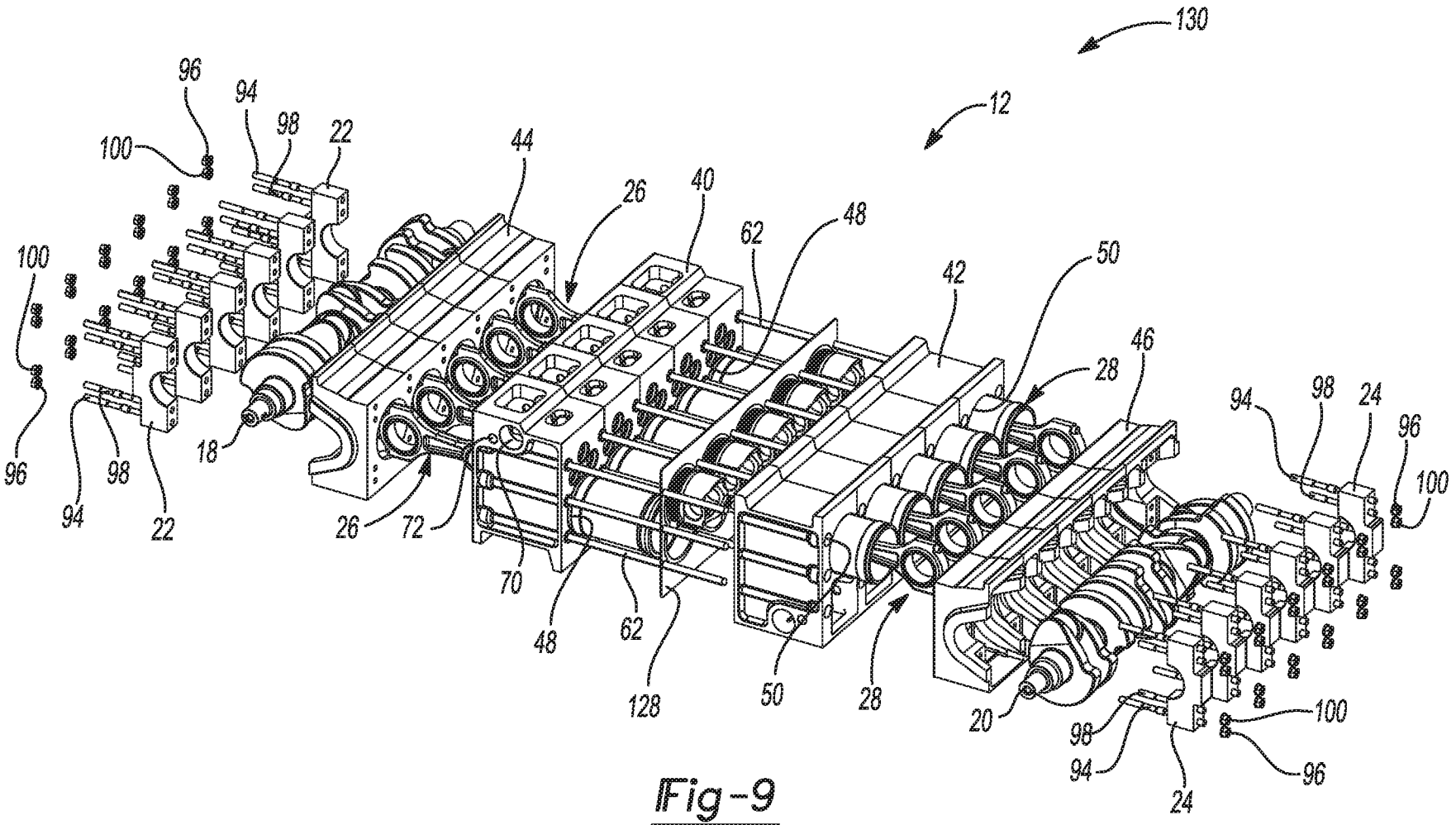
FIG. 9 is an exploded perspective view of the OP4S engine of FIG. 8.

Referring now to FIGS. 8 and 9, an OP4S engine 130 is similar or identical to the OP4S engine 10 except that the OP4S engine 130 has 5 cylinders instead of a single cylinder. Thus, the OP4S engine 130 either has the same components as the OP4S engine 10, albeit five times as many, or the components of the OP4S engine 130 are similar to the components of the OP4S engine 10 but modified to accommodate the greater number of cylinders. For example, the first center section 40 of the OP4S engine 130 defines five of the first cylinder half bores 48, and the second center section 42 of the OP4S engine 130 defines five of the second cylinder half bores 50. Notably, the section views shown in FIGS. 3 and 4 also illustrate the OP4S engine 130.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. An engine block for an opposed-piston engine, the engine block comprising:

a first center section defining a first cylinder half bore and a first plurality of fastener bores that extend from a first end of the first center section to a second end of the first center section, the first cylinder half bore having a first longitudinal axis;

a second center section defining a second cylinder half bore and a second plurality of fastener bores that extend from a first end of the second center section to a second end of the second center section, the second cylinder half bore having a second longitudinal axis, wherein the first end of the second center section is configured to abut the second end of the first center section such that:

the first and second cylinder half bores are in fluid communication with one another to collectively form a single cylinder;

the first and second longitudinal axes are offset from one another; and the first and second pluralities of fastener bores are aligned with one another for receiving a first plurality of fasteners to join the first and second center sections to one another;

a first crankcase at least partially defining a first crankshaft bore configured to receive a first crankshaft, wherein the first crankcase is configured to abut the first end of the first center section; and a second crankcase at least partially defining a second crankshaft bore configured to receive a second crankshaft, wherein the second crankcase is configured to abut the second end of the second center section.

2. The engine block of claim 1 wherein:

each fastener bore in the first plurality of fastener bores has a first counterbore located at the first end of the first center section; and each fastener bore in the second plurality of fastener bores has a second counterbore located at the second end of the second center section.

3. The engine block of claim 1 wherein:

the first center section defines a third plurality of fastener bores that are offset from the first plurality of fastener bores and are configured to receive a second plurality of fasteners to join the first crankcase to the first center section; and the second center section defines a fourth plurality of fastener bores that are offset from the second plurality of fastener bores and are configured to receive a third plurality of fasteners to join the second crankcase to the second center section.

4. The engine block of claim 3 wherein:

the third plurality of fastener bores have internal threads for engaging external threads on the second plurality of fasteners; and the fourth plurality of fastener bores have internal threads for engaging external threads on the third plurality of fasteners.

5. The engine block of claim 3 wherein:

the first crankcase defines a first plurality of through bores configured to be aligned with the third plurality of fastener bores to allow insertion of the second plurality of fasteners through the first plurality of through bores and into the third plurality of fastener bores to join the first crankcase to the first center section; and the second crankcase defines a second plurality of through bores configured to be aligned with the fourth plurality of fastener bores to allow insertion of the third plurality of fasteners through the second plurality of through bores and into the fourth plurality of fastener bores to join the second crankcase to the second center section.

6. The engine block of claim 5 further comprising:

a first crank bearing saddle, each of the first crankcase and the first crank bearing saddle defining a crankshaft partial bore, the crankshaft partial bore in the first crankcase cooperating with the crankshaft partial bore in the first crank bearing saddle to form the first crankshaft bore; and a second crank bearing saddle, each of the second crankcase and the second crank bearing saddle defining a crankshaft partial bore, the crankshaft partial bore in the second crankcase cooperating with the crankshaft partial bore in the second crank bearing saddle to form the second crankshaft bore.

7. An engine block for an opposed-piston engine, the engine block comprising:

a first center section defining a first cylinder half bore having a first longitudinal axis;

a second center section defining a second cylinder half bore having a second longitudinal axis that is offset from the first longitudinal axis, the first and second cylinder half bores being in fluid communication with one another;

a first crankcase at least partially defining a first crankshaft bore;

a second crankcase at least partially defining a second crankshaft bore;

a first plurality of fasteners joining the first and second center sections to one another;

a second plurality of fasteners joining the first crankcase to the first center section; and a third plurality of fasteners joining the second crankcase to the second center section.

8. The engine block of claim 7 wherein:

the first cylinder half bore extends from a first end of the first center section to a second end of the first center section;

the second cylinder half bore extends from a first end of the second center section to a second end of the second center section;

the first end of the second center section abuts the second end of the first center section;

the first crankcase abuts the first end of the first center section; and the second crankcase abuts the second end of the second center section.

9. The engine block of claim 8 wherein:

the first center section defines a first plurality of fastener bores that extend from the first end of the first center section to the second end of the first center section;

the second center section defines a second plurality of fastener bores that extend from the first end of the second center section to the second end of the second center section; and the first plurality of fasteners extend through the first plurality of fastener bores and the second plurality of fastener bores to join the first and second center sections to one another.

10. The engine block of claim 9 further comprising:

a first crank bearing saddle, each of the first crankcase and the first crank bearing saddle defining a crankshaft partial bore, the crankshaft partial bore in the first crankcase cooperating with the crankshaft partial bore in the first crank bearing saddle to form the first crankshaft bore, wherein the second plurality of fasteners extend through the first crank bearing saddle and the first crankcase to join the first crank bearing saddle and the first crankcase to the first center section; and a second crank bearing saddle, each of the second crankcase and the second crank bearing saddle defining a crankshaft partial bore, the crankshaft partial bore in the second crankcase cooperating with the crankshaft partial bore in the second crank bearing saddle to form the second crankshaft bore, wherein the third plurality of fasteners extend through the second crank bearing saddle and the second crankcase to join the second crank bearing saddle and the second crankcase to the second center section.

11. The engine block of claim 10 wherein:

the first crankcase and the first crank bearing saddle form a first crankcase assembly having a central horizontal plane that is offset from a central horizontal plane of the first center section; and the second crankcase and the second crank bearing saddle form a second crankcase assembly having a central horizontal plane that is offset from a central horizontal plane of the second center section.

12. An opposed-piston engine comprising:

the engine block of claim 9;

a first crankshaft received in the first crankshaft bore, wherein the first crankshaft has a longitudinal axis that is disposed within the same plane as the first longitudinal axis of the first cylinder half bore; and a second crankshaft received in the second crankshaft bore, wherein the second crankshaft has a longitudinal axis that is disposed within the same plane as the second longitudinal axis of the second cylinder half bore.

13. The engine block of claim 7 wherein:

each fastener in the first plurality of fasteners has a first length;

each fastener in the second plurality of fasteners has a second length;

each fastener in the third plurality of fasteners has a third length; and the second and third lengths are greater than the first length.

14. An engine block for an opposed-piston engine, the engine block comprising:

a first center section having a central horizontal plane and defining at least one first cylinder half bore having a first longitudinal axis;

a second center section having a central horizontal plane and defining at least one second cylinder half bore having a second longitudinal axis that is offset from the first longitudinal axis, wherein the at least one first cylinder half bore is in fluid communication with the at least one second cylinder half bore to form at least one cylinder;

a first crankcase assembly defining a first crankshaft bore and having a central horizontal plane that is offset from the central horizontal plane of the first center section; and a second crankcase assembly defining a second crankshaft bore and having a central horizontal plane that is offset from the central horizontal plane of the second center section.

15. The engine block of claim 14 wherein:

the second longitudinal axis of the at least one second cylinder half bore is offset from the first longitudinal axis of the at least one first cylinder half bore by a first distance;

the central horizontal plane of the first crankcase assembly is offset from the central horizontal plane of the first center section by a second distance;

the central horizontal plane of the second crankcase assembly is offset from the central horizontal plane of the second center section by the second distance; and the second distance is equal to one-half of the first distance.

16. The engine block of claim 14 wherein:

the first crankcase assembly includes a first crankcase and a first crank bearing saddle that cooperate with one another to form the first crankshaft bore; and the second crankcase assembly includes a second crankcase and a second crank bearing saddle that cooperate with one another to form the second crankshaft bore.

17. An opposed-piston engine comprising:

the engine block of claim 14;

a first crankshaft received in the first crankshaft bore, wherein the first crankshaft has a longitudinal axis that is disposed within the same plane as the first longitudinal axis of the at least one first cylinder half bore; and a second crankshaft received in the second crankshaft bore, wherein the second crankshaft has a longitudinal axis that is disposed within the same plane as the second longitudinal axis of the at least one second cylinder half bore.

18. The opposed-piston engine of claim 17 further comprising:

at least one first piston connected to the first crankshaft and configured to reciprocate within the at least one first cylinder half bore; and at least one second piston connected to the second crankshaft and configured to reciprocate within the at least one first cylinder half bore, wherein combustion within the at least one cylinder causes the at least one first piston and the at least one second piston to translate toward one another and away from one another, which drives rotation of the first and second crankshafts.

19. The opposed-piston engine of claim 18 wherein:

the at least one first cylinder half bore includes a plurality of first cylinder half bores;

the at least one second cylinder half bore includes a plurality of second cylinder half bores;

each of the second cylinder half bores is in fluid communication with one of the first cylinder half bores;

the at least one first piston includes a plurality of first pistons;

each of the first pistons is configured to reciprocate within one of the first cylinder half bores;

the at least one second piston includes a plurality of second pistons; and each of the second pistons is configured to reciprocate within one of the second cylinder half bores.

* * * * *